US005873540A

United States Patent [19]

Hardin

[11] Patent Number: 5,873,540

[45] Date of Patent: Feb. 23, 1999

[54] ADJUSTABLE CHRISTMAS LIGHT SPOOL

[76] Inventor: Randy Hardin, P.O. Box 246, Hennessey, Okla. 73742

[21] Appl. No.: 926,594

[22] Filed: Aug. 18, 1997

[51] Int. Cl.[6] ..... B65H 75/38

[52] U.S. Cl. ..... 242/405.1; 242/388; 242/578; 242/608.7; 206/406

[58] Field of Search ..... 242/388, 388.1, 242/388.6, 405, 405.1, 578, 578.1, 601, 608.5, 608.7, 609, 609.1, 609.2, 609.3, 613; 206/403, 404, 405, 406

[56] References Cited

U.S. PATENT DOCUMENTS

| | | | |
|---|---|---|---|
| 1,066,319 | 7/1913 | Powell | 242/578 |
| 1,374,543 | 4/1921 | Ashworth | 242/578 |
| 1,609,309 | 12/1926 | Renz . | |
| 2,141,610 | 12/1938 | Little et al. | 242/608.5 X |
| 2,319,731 | 5/1943 | Garrett . | |
| 2,364,262 | 12/1944 | Wehringer . | |
| 3,144,104 | 8/1964 | Weir et al. | 242/578.1 X |
| 3,601,330 | 8/1971 | Minobe . | |
| 4,150,798 | 4/1979 | Aragon . | |
| 4,390,142 | 6/1983 | Cheng . | |
| 4,428,546 | 1/1984 | Weidman | 242/578.1 |

FOREIGN PATENT DOCUMENTS

| | | | |
|---|---|---|---|
| 700488 | 12/1964 | Canada | 242/588 |
| 345050 | 4/1960 | Switzerland | 242/388.1 |

*Primary Examiner*—Donald P. Walsh
*Assistant Examiner*—William A. Rivera

[57] ABSTRACT

An adjustable Christmas light spool including a pair of covers each including a torus portion. The torrid portion is defined by a full torus sliced by a plane which resides perpendicular with respect to a center axis of the full torus thereby defining an annular dish. Further included is an adjustable central coupling associated with each cover. By this structure, a string of Christmas lights may be wrapped about the central coupling and the covers may be expanded and contracted for providing optimal protection to the Christmas lights.

2 Claims, 3 Drawing Sheets

FIG 1
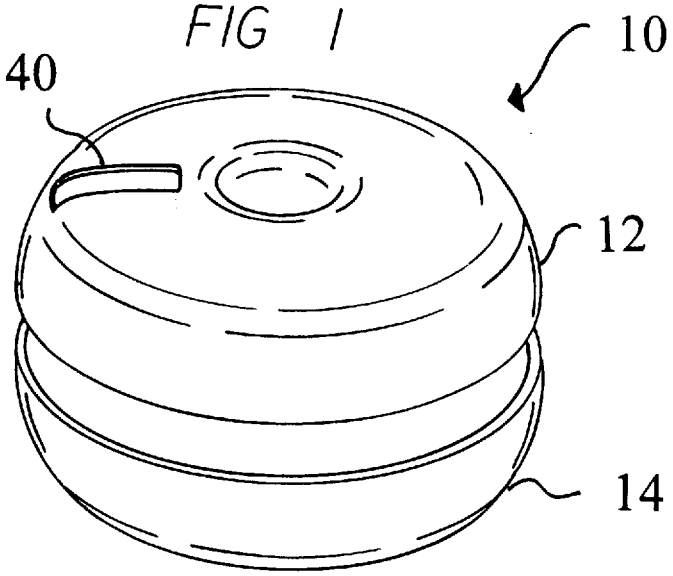
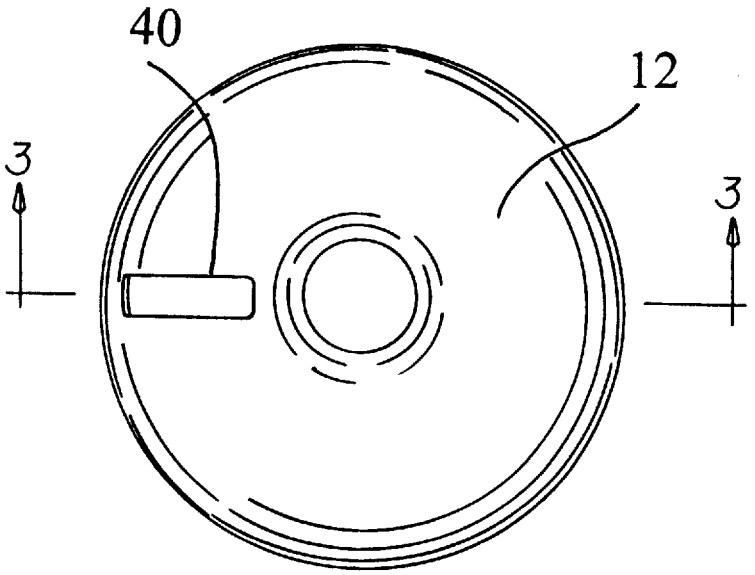
FIG 2

FIG 5
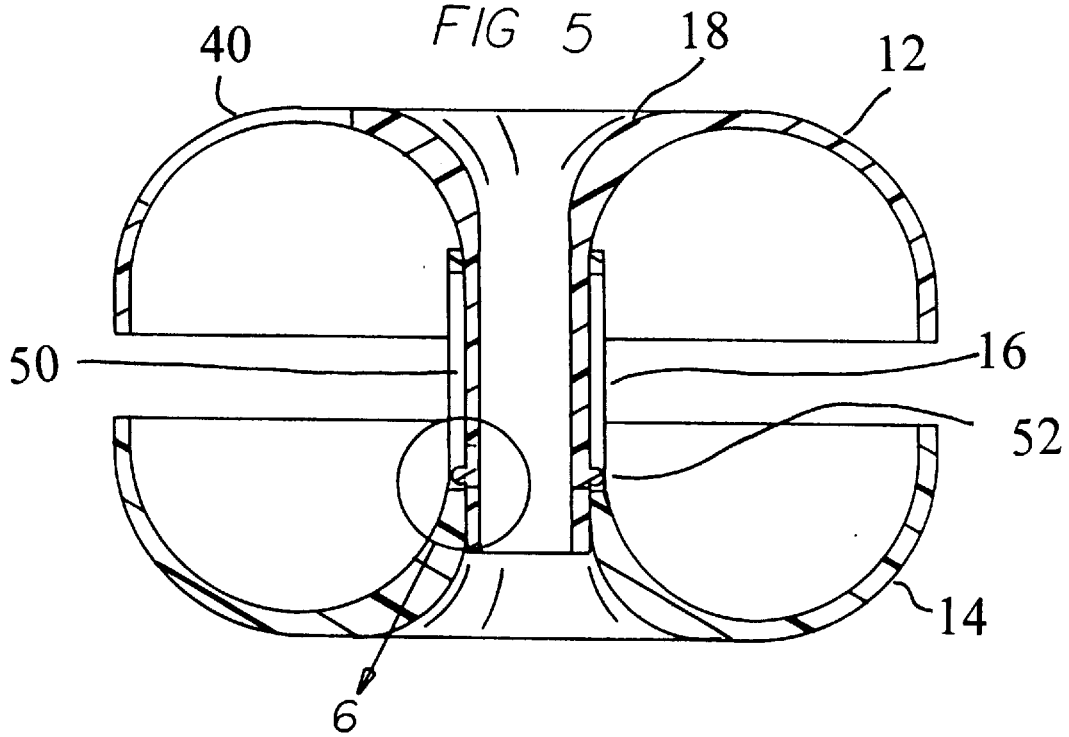
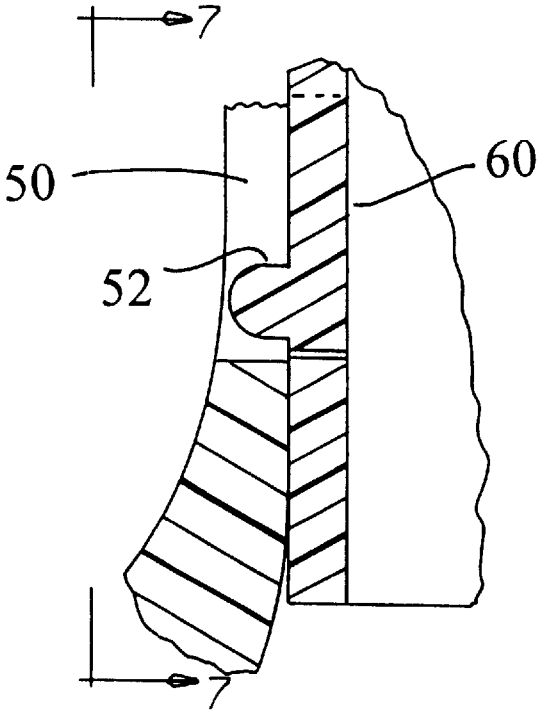
FIG 6
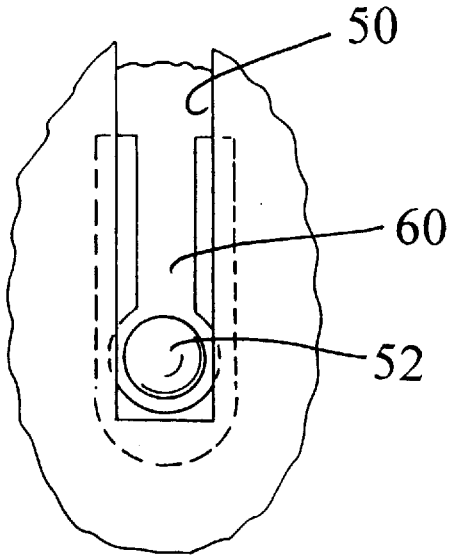
FIG 7

ADJUSTABLE CHRISTMAS LIGHT SPOOL

BACKGROUND OF THE INVENTION

1. Field of the Invention

The present invention relates to an adjustable Christmas light spool and more particularly pertains to storing and protecting a string of Christmas lights.

2. Description of the Prior Art

The use of adjustable spools is known in the prior art. More specifically, adjustable spools heretofore devised and utilized for the purpose of containing wires are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 4,917,323 to Wing; U.S. Pat. No. 4,500,047 to Merlin; U.S. Pat. No. 4,101,095 to Carter; and U.S. Pat. No. 4,428,546 to Weidman.

In this respect, the adjustable Christmas light spool according to the present invention substantially departs from the conventional concepts and designs of the prior art, and in so doing provides an apparatus primarily developed for the purpose of storing and protecting a string of Christmas lights.

Therefore, it can be appreciated that there exists a continuing need for a new and improved adjustable Christmas light spool which can be used for storing and protecting a string of Christmas lights. In this regard, the present invention substantially fulfills this need.

SUMMARY OF THE INVENTION

In view of the foregoing disadvantages inherent in the known types of adjustable spools now present in the prior art, the present invention provides an improved adjustable Christmas light spool. As such, the general purpose of the present invention, which will be described subsequently in greater detail, is to provide a new and improved adjustable Christmas light spool which has all the advantages of the prior art and none of the disadvantages.

To attain this, the present invention essentially comprises an upper extent and a lower extent. Each of such extents includes a central tube with a cylindrical configuration. Further, both extents have a cover including a torus portion. The torus portion is defined by a full torus sliced by a plane which resides perpendicular with respect to a center axis of the full torus. As such, an annular dish is defined. The torrid portion of both extents have an inner periphery integrally coupled to the central tube in concentric relationship therewith. The cover of the upper and lower extents further include a cylinder portion having a periphery integrally coupled with an outer periphery of the torus portion. Such cylindrical portion extends over at least ⅙ a length of the central tube. As best shown in FIGS. 3 & 4, the central tubes of the upper and lower extents differ to facilitate the adjustable coupling thereof. First, the central tube of the upper extents has a diameter that is less than that of the lower extent. Further, the central tube of the upper extent has a plurality of threaded grooves formed in serpentine fashion in an outer surface thereof. Conversely, the central tube of the lower extent has a plurality of threaded grooves formed in serpentine fashion in an inner surface thereof. As best shown in FIGS. 1 & 2, a rectangular slot is formed in the torus portion of the upper extent and extending radially from a center thereof.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved adjustable Christmas light spool which has all the advantages of the prior art adjustable spools and none of the disadvantages.

It is another object of the present invention to provide a new and improved adjustable Christmas light spool which may be easily and efficiently manufactured and marketed.

It is a further object of the present invention to provide a new and improved adjustable Christmas light spool which is of a durable and reliable construction.

An even further object of the present invention is to provide a new and improved adjustable Christmas light spool which is susceptible of a low cost of manufacture with regard to both materials and labor, and which accordingly is then susceptible of low prices of sale to the consuming public, thereby making such adjustable Christmas light spool economically available to the buying public.

Still yet another object of the present invention is to provide a new and improved adjustable Christmas light spool which provides in the apparatuses and methods of the prior art some of the advantages thereof, while simultaneously overcoming some of the disadvantages normally associated therewith.

Still another object of the present invention is to store and protect a string of Christmas lights.

Lastly, it is an object of the present invention to provide a new and improved adjustable Christmas light spool including a pair of covers each having a torus portion. The torus portion is defined by a full torus sliced by a plane which resides perpendicular with respect to a center axis of the full torus thereby defining an annular dish. Further included is an adjustable central coupling associated with each cover. By this structure, a string of Christmas lights may be wrapped about the central coupling and the covers may be expanded and contracted for providing optimal protection to the Christmas lights.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of the preferred embodiment of the adjustable Christmas light spool constructed in accordance with the principles of the present invention.

FIG. 2 is a top view of the present invention.

FIG. 5 is a cross-sectional view of an alternate embodiment of the present invention.

FIG. 6 is a close-up view of the encircled area 6 shown in FIG. 5.

FIG. 7 is a close-up view of the detent and slot combination of the alternate embodiment.

Similar reference characters refer to similar parts throughout the several views of the drawings.

DESCRIPTION OF THE PREFERRED EMBODIMENT

Figure 3:
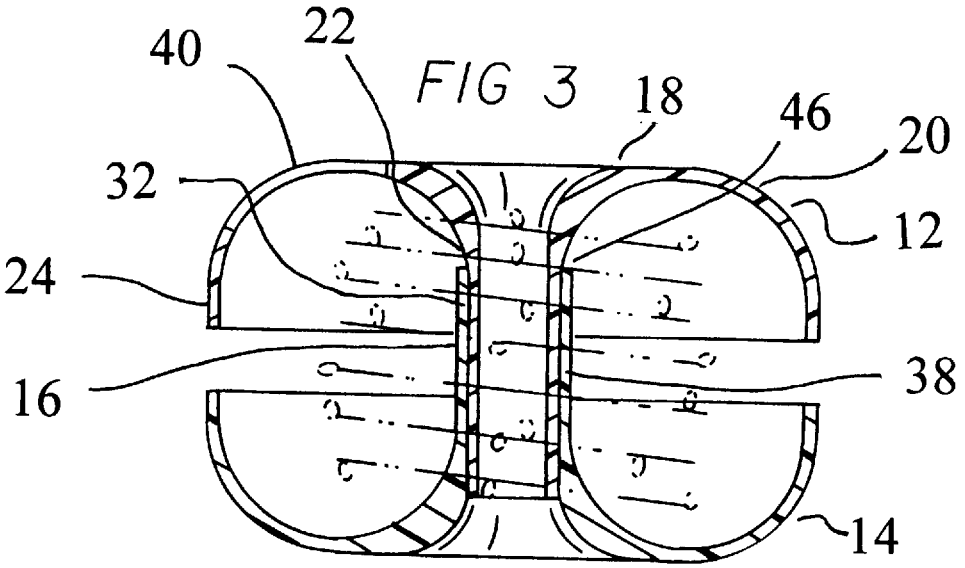
FIG. 3 is a cross-sectional view of the present invention taken along line 3—3 shown in FIG. 2 with the covers in a contracted orientation.

With reference now to the drawings, and in particular to FIG. 1 thereof, a new and improved adjustable Christmas light spool embodying the principles and concepts of the present invention and generally designated by the reference numeral 10 will be described.

The present invention, the new and improved adjustable Christmas light spool, is comprised of a plurality of components. Such components in their broadest context include an upper extent, a lower extent, and a slot. Such components are individually configured and correlated with respect to each other so as to attain the desired objective.

More specifically, it will be noted that the system 10 of the present invention includes an upper extent 12 and a lower extent 14. Each of such extents includes a central tube 16 with a cylindrical configuration. Further, both extents have a cover 18. Such cover first includes a torus portion 20. The torrid portion is defined by a full torus sliced by a plane which resides perpendicular with respect to a center axis of the full torroid. As such, an annular dish is defined. Preferably, the aforementioned slice is such that less than half of a circle is defined by a cross-section taken by a plane which resides coincident with the center axis of the full torus. The torrid portion of both extents have an inner periphery 22 integrally coupled to the corresponding central tube in concentric relationship therewith.

The cover of the upper and lower extents further include a cylinder portion 24 having a periphery integrally coupled with an outer periphery of the torus portion. Such cylindrical portion extends over at least ⅙ a length of the central tube. Preferably, the height or depth of each torus portion is approximately equal to that of the cylindrical portion of the each cover.

Figure 4:
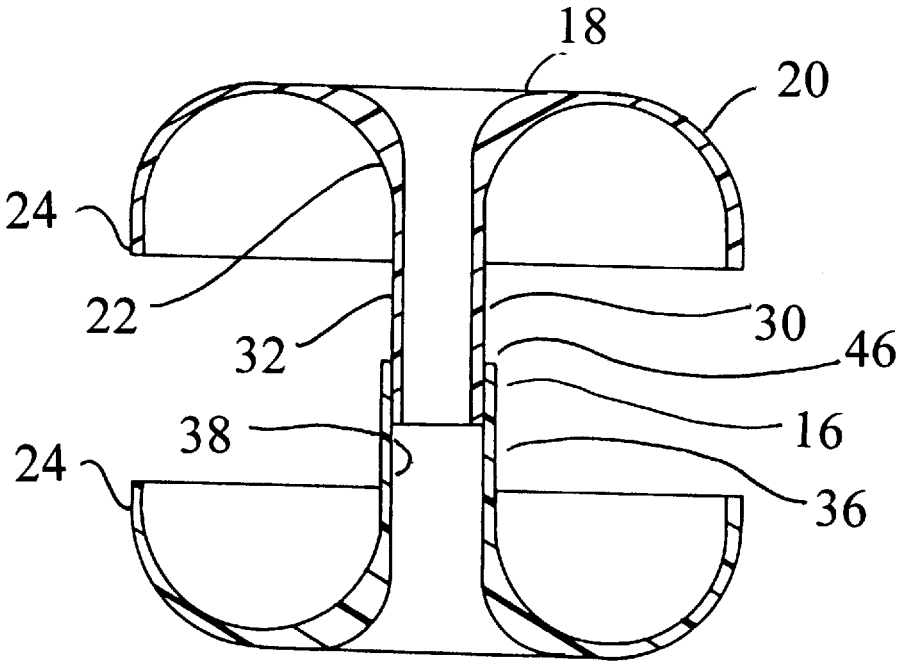
FIG. 4 is a cross-sectional view of the present invention taken along line 3—3 shown in FIG. 2 with the covers in an expanded orientation.

As best shown in FIGS. 3 & 4, the central tubes of the upper and lower extents differ to facilitate the adjustable coupling thereof. First, the central tube 30 of the upper extents has a diameter that is less than that of the lower extent. Further, the central tube of the upper extent has a plurality of threaded grooves 32 formed in serpentine fashion on an entire outer surface thereof. Conversely, the central tube 36 of the lower extent has a plurality of threaded grooves 38 formed in serpentine fashion in an entire inner surface thereof. It should be noted that the central tubes are both hollow and are in communication with apertures of the covers for allowing the present invention to be hung on a post.

As best shown in FIGS. 1 & 2, a rectangular slot 40 is formed in the torus portion of the upper extent and extended radially from a center thereof. As shown in FIG. 5, the slot extends from a point that is proximate to the apex of the annular dish and extends radially outwardly to a point adjacent the outer periphery of the torus portion of the cover. The slot thus allows the insertion of a plug therein for reasons that will become apparent later.

In use, the threaded grooves of the upper extent may be engaged with those of the lower extent and a string of Christmas lights may be wrapped about the central tubes of the upper and lower extents. In the present description, the string of Christmas lights consists of a wire with a plurality of spaced small bulbs coupled thereto. For providing optimal protection to the Christmas lights, the covers of the upper and lower extents may be expanded and contracted via the rotation of the upper extent with respect to the lower extent. It should be noted that, in use, the cylindrical portions of the upper and lower extents reside in a common cylinder. Further, to prevent the movement of a leading end 46 of the central tube of the lower extent from binding the string of Christmas lights, such leading end is bevelled about its entire periphery thereby having a frusto-conical configuration.

FIGS. 5–7 shows an alternate embodiment which utilizes a different coupling means. Basically, each tube is equipped with a cylindrical configuration similar to the previous embodiment. The central tube of the lower extent has a pair of diametrically opposed slots 50 extending along an entire length thereof. The central tube of the upper extent has a pair of diametrically opposed detents 52 formed at a free end thereof. By this structure, the central tube of the upper extent is adapted to be slidably situated within the central tube of the lower extent such that the detent of the tube of the upper extent is slidably situated through the slot of the tube of the lower extent thereby precluding the separation of the tubes. As an option, the detent may be formed on a deformable tab 60 such that upon the full extension of the covers, the detents and tabs may be depressed inwardly such that the covers may be completely separated.

While two means of affording adjustable coupling have been discussed, it should be understood that any other sort of adjustable coupling may be utilized to afford a similar function.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A adjustable Christmas light spool comprising, in combination:

a string of Christmas lights;

an upper extent including a hollow central tube with a cylindrical configuration, the upper extent having a cover including a torus portion, the torus portion defined by a full torus sliced by a plane which resides perpendicular with respect to a center axis of the full torus thereby defining an annular dish with a cross-section defining a half of a circle, the torus portion of the upper extent having an inner periphery integrally coupled to the central tube in concentric relationship therewith, the cover of the upper extent further including a cylinder portion having a periphery integrally coupled with an outer periphery of the torus portion and extending over at least ⅙ a length of the central tube, wherein a height of the torus portion of the upper extent is approximately equal to that of the cylinder portion of the upper extent;

a rectangular slot formed in the torus portion of the upper extent for passing a plug of the string of Christmas lights, wherein the slot extends from a point that is proximate to an apex of the annular dish and extends outwardly to a point adjacent the outer periphery of the torus portion; and an lower extent including a hollow central tube with a cylindrical configuration, wherein the central tube of the lower extent has a diameter greater than that of the upper extent and further has a frusto-conical, tapered upper end for preventing the movement of a leading end of the central tube of the lower extent from binding the string of Christmas lights, the lower extent having a cover including a torus portion, the torus portion defined by a full torus sliced by a plane which resides perpendicular with respect to a center axis of the full torus thereby defining an annular dish with a cross-section defining a half of a circle, the torus portion of the lower extent having an inner periphery integrally coupled to the central tube in concentric relationship therewith, the cover of the lower extent further including a cylinder portion having a periphery integrally coupled with an outer periphery of the torus portion and extending over at least ⅙ a length of the central tube, wherein a height of the torus portion of the lower extent is approximately equal to that of the cylinder portion of the lower extent;

whereby the upper extent may be engaged with the lower extent and the string of Christmas lights may be wrapped about the central tubes of the upper and lower extents and the covers of the upper and lower extents may be expanded and contracted for providing optimal protection to the Christmas lights, wherein the cylindrical portions of the upper and lower extents reside in a common cylinder.

2. The adjustable Christmas light spool as set forth in claim 1 wherein the central tube of the lower extent has a pair of diametrically opposed slots extending along an entire length thereof and wherein the central tube of the upper extent has a pair of diametrically opposed detents each formed on a deformable tab, wherein the central tube of the upper extent is adapted to be slidably situated within the central tube of the lower extent such that the detents are slidably situated through the slots thereby precluding the separation of the upper extent and lower extent, wherein the detents may be depressed inwardly such that the upper and lower extents are separable.

* * * * *